United States Patent [19]

Coleman

[11] 4,105,930

[45] Aug. 8, 1978

[54] LOAD AND HOLD MEANS FOR PLASMA DISPLAY DEVICES

[75] Inventor: William E. Coleman, St. Charles, Ill.

[73] Assignee: NCR Corporation, Dayton, Ohio

[21] Appl. No.: 706,578

[22] Filed: Jul. 19, 1976

[51] Int. Cl.[2] ..... H05B 39/00

[52] U.S. Cl. ..... 315/169 TV; 340/324 M

[58] Field of Search ..... 315/169 R, 169 TV; 340/324 M; 313/217

[56] References Cited

U.S. PATENT DOCUMENTS

| | | | |
|---|---|---|---|
| 3,786,307 | 1/1974 | Robinson | 315/169 R X |
| 3,786,474 | 1/1974 | Miller | 315/169 R X |
| 3,849,693 | 11/1974 | Kuchinsky et al. | 315/169 R X |
| 3,892,568 | 7/1975 | Ota | 340/324 M X |
| 3,894,506 | 7/1975 | Mayer et al. | 315/169 R X |
| 3,908,151 | 9/1975 | Schermerhorn | 315/169 R X |
| 3,990,068 | 11/1976 | Mayer et al. | 315/169 R X |
| 4,027,197 | 5/1977 | Coleman | 340/324 M X |
| 4,030,091 | 6/1977 | Ngo | 315/169 R X |

*Primary Examiner*—Peter A. Nelson

*Attorney, Agent, or Firm*—J. T. Cavender; Lowell C. Bergstedt; Philip A. Dalton, Jr.

[57] ABSTRACT

A plasma discharge display device including at least one channel defined between opposing walls and containing an ionizable medium. Electrodes are employed for the application of potential differences whereby the medium will emit light proximate the electrodes. The electrodes include first and second AC electrodes on opposite wall surfaces, and third and fourth electrodes for developing a DC discharge in the vicinity of the first and second AC electrodes. The channel is divided into individual cells by means of insulating walls, and the DC discharge serves to prime individual cells, this discharge being developed at succeeding cells. The potential differences achieved by the AC electrodes across a given cell are selectively imparted whereby a primed cell can be caused to emit light. Thereafter, continued operation of the AC electrodes will maintain the light emission in the selected cells to provide a continuous display.

19 Claims, 6 Drawing Figures

LOAD AND HOLD MEANS FOR PLASMA DISPLAY DEVICES

BACKGROUND OF THE INVENTION

This invention is directed to a plasma discharge display device wherein novel means are provided for loading the device and for holding displays in the device.

The basic phenomena involved in the operation of plasma discharge display devices are referred to in Coleman, et al. U.S. Pat. No. 3,781,600, dated Dec. 25, 1973, and entitled "Plasma Charge Transfer Device". Such devices generally comprise a channel containing an ionizable medium, particularly an ionizable gas such as neon and nitrogen. The channel is defined within a walled structure, and for display purposes, at least one wall is formed of a transparent material. Electrodes are provided on opposite sides of the channel, and by applying potential differences between oppositely positioned electrodes, gas ionization and light emission occurs.

In such prior devices, provision is made for transfer of light emitting areas so that portions of displays can be successively introduced into the devices, and the displays shifted along the length of the devices. Provision is also made for holding of the displays in a give position when so desired.

THE PRESENT INVENTION

This invention is directed to a plasma discharge display device of a completely unique construction. This construction, in particular, utilizes a unique arrangement of DC and AC electrodes which function to develop light emitting cells in the display device. The cells which characterize the device are formed by means of walls of insulating material which extend between the opposed front and back walls of the device. Since, in accordance with typical construction, the front wall of such a device is transparent, the light emitting cells will be visible. Light emitting patterns in the form of letters and numbers are developed by selecting individual cells for light emission. The selection of the cells is accomplished by controlling the operation of the AC and DC electrodes. Formation of the patterns to be displayed is efficiently accomplished with the construction of the invention, and holding of the displays is also accomplished in a highly efficient manner.

The main object of this invention is, thus, the provision of a plasma discharge display device which is capable of receiving and holding patterns in a highly effective and efficient manner.

It is a further object of the invention to provide for the operation of such a device through the utilization of control means which are highly effective for purposes of developing and holding displays in the device.

These and other objects of the invention will appear hereinafter and for purposes of illustration, but not of limitation, the specific embodiments of the invention are shown in the accompanying drawings in which.

The subject matter of this invention generally relates to plasma discharge display devices, and in particular, to the structure utilized in the devices for achieving loading of a display into the devices, and for achieving holding of displays which have been developed. The system is particularly characterized by a combination of AC and DC electrodes which are disposed in the device on opposite walls whereby opposed electrode surfaces are provided. The device is further characterized by the formation of a plurality of individual cells. These cells are formed by means of insulating walls which extend between the front and back walls of the device. Opposed electrode surfaces are formed at the top and bottom of the individual cells whereby potential differences can be developed across each individual cell.

The individual cells are characterized by priming holes, and corridors are formed between the cells in a given line with the priming holes communicating with these corridors. Opposed electrode surfaces are defined along the corridors, and these electrodes are employed for creating priming charges for individual cells.

In accordance with the concepts of this invention, the application of potential differences across a given cell, combined with the development of a priming charge for that cell, results in ionization and light emission in that cell. The insulating walls which form the cell confine the light emitting area, and by applying holding pulses, the light emission of a given cell can be indefinitely maintained. By selectively developing light emitting cells, patterns in the form of letters, numbers, etcetera, can be developed in a given device and maintained for display purposes.

Figure 3:
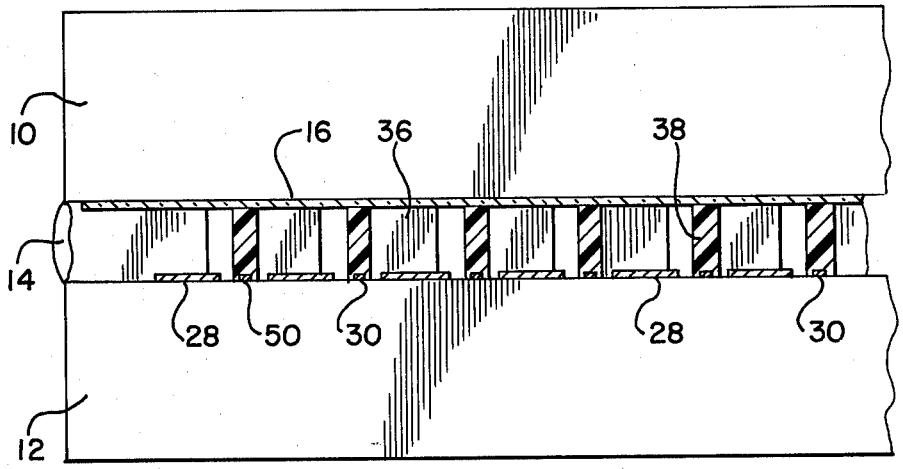
FIG. 3 is a cross-sectional view of the device taken about the line 3—3 of FIG. 1 and including front and back plates utilized in the device.
Figure 4:
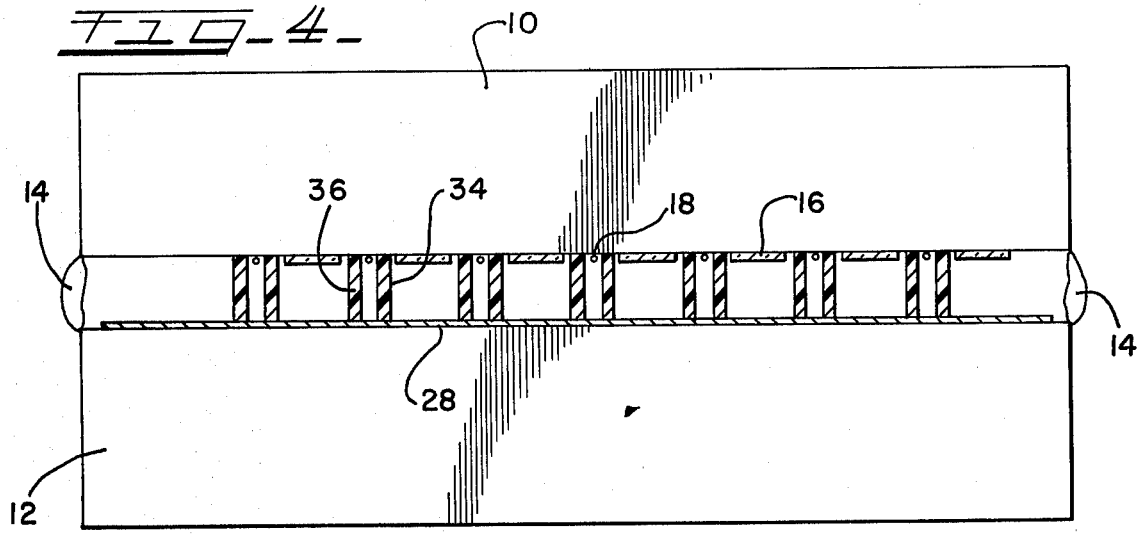
FIG. 4 is a cross-sectional view taken about the line 4—4 of FIG. 1 and illustrating the front and back plates utilized in the device.

The accompanying drawings more specifically illustrate the type of plasma discharge display devices contemplated by this invention. Referring first to FIGS. 3 and 4, there are illustrated front and back plates 10 and 12 which are of the usual design for devices of this type. Specifically, the front plate 10 will be formed of any suitable glass whereby the light emission which is developed will result in a visible display. The back plate 12 may be formed of any suitable transparent or opaque material. In this connection, it will be understood that operation of the structure of the invention will result in ionization of the gases confined between the plates even if both plates were opaque, and that the concepts of the invention can be practiced even in a system which did not require light emission.

As illustrated, the plates 10 and 12 are maintained in spaced apart relationship, and an ionizable medium such as any one of, or a mixture of, the gaeses neon, argon, helium, krypton, xenon, hydrogen, and nitrogen, is sealed within the channel. Any suitable sealing compound 14 may be provided around the periphery of the construction for this purpose.

The inner facing surfaces of the plates 10 and 12 have electrodes positioned thereon. In the case of the plate 10, AC electrodes 16 (subscripts 1–7) are provided. These AC electrodes 16 are formed of a transparent material such as tin oxide in order to provide visibility through the electrodes.

Also positioned adjacent the inner surfaces of the plate 10 are a plurality of DC coupled electrodes 18. These DC electrodes may take the form of wires or screened conductors with one electrode being located between each of the AC electrodes 16. A common busing line 20 is provided for energization of electrodes 18. A thin insulating coating, in accordance with conventional practice, is applied over the electrodes 16 the electrodes 18 being free of this coating, at least, as will be explained, at points opposite points on opposed DC electrodes. This coating may comprise, for example, a transparent dielectric glass such as Corning 7570 supplied by Corning Glass. The glass is formed of a silk screened glass paste when provided on the surface of the transparent plate 10.

The construction of this invention is further characterized by electrodes formed on the opposing plate surface 12. These electrodes comprise an AC coupled structure 24 consisting of a busing section 26 and electrodes 28 in the form of fingers extending outwardly from the section 26. In the embodiment illustrated, the structure 24 consists of six fingers, and it will be appreciated that a plurality of such structures are provided along the length of the device, depending upon the desired display area. The number of fingers 28 in a given structure 24 is not critical to the operation of the construction and is selected solely for convenient production and assembly.

Also positioned adjacent the surface of the plate 12 are a plurality of DC electrodes 30, one of these electrodes 30 extending between adjacent electrodes 28. A suitable dielectric coating may also be selectively applied over the surface of plate 12 in accordance with conventional practice, silk screening being utilized in a typical case. The areas of the electrodes 30 which intersect areas of electrodes 18 are left free of this coating so that respective areas are DC coupled to the gas at these intersections.

As illustrated, the plates 10 and 12 are located in spaced apart relationship, and insulating walls extend between the facing surfaces of these plates. These walls consist of transversely extending walls including a wall 32 extending across the top of the structure, and interior transversely extending walls 34. Short transversely extending wall sections 36 are formed in spaced relationship with respect to the walls 32 and 34 with a plurality of transversely extending corridors being thereby defined by the device. As illustrated, the DC electrodes 18 extend along these corridors, adjacent the top thereof.

A vertical wall 37 is formed on one side of the device and additional wall sections 38 are formed at right angles relative to the wall sections 36, the sections 38 extending to the walls 34. It will also be noted that the wall sections 36 terminate short of the wall sections 38, this resulting in openings 40 which provide communication between the corridors and the individual cells which are defined by the wall sections.

The DC electrodes 30 are coextensive with the bottom ends of wall sections 38 with the electrodes 30 being embedded in the wall sections except in the area of the transversely extending corridors. The electrodes 30 and 18 are thus positioned so that areas of these electrodes are directly opposite each other at regularly spaced intervals along the length of the corridors. These intervals correspond with the spacing between openings 40 of the individual cells. Accordingly, priming charges can be selectively developed between given areas of the electrodes 30 and 18 adjacent particular openings 40 with the gas located in an individual cell being affected only by a charge developed adjacent that cell. The gas of an individual cell is effectively isolated from the electrode areas associated with other cells so that the electrical conditions in these other cells will not be a factor in determining the ionization of the gas.

All of the electrodes illustrated are connected to a signal source and, as indicated, individual switching 42 is available with respect to the electrodes 16 and individual switching 44 is provided for the electrodes 30. In the case of electrodes 30, these are conveniently coupled in sets of three and a single switch 44 thus operates a plurality of these electrodes. In the drawing, all electrodes $30_1$ are operated simultaneously, and the same is true with respect to the electrodes $30_2$ and $30_3$. In order to further simplify the explanation, the electrodes 16 are designated by subscripts 1–7.

Switches 46 and 48 are connected, respectively, to the common conductors 20 and 26 for controlling the coupled electrodes 18 and 28.

Figure 1:
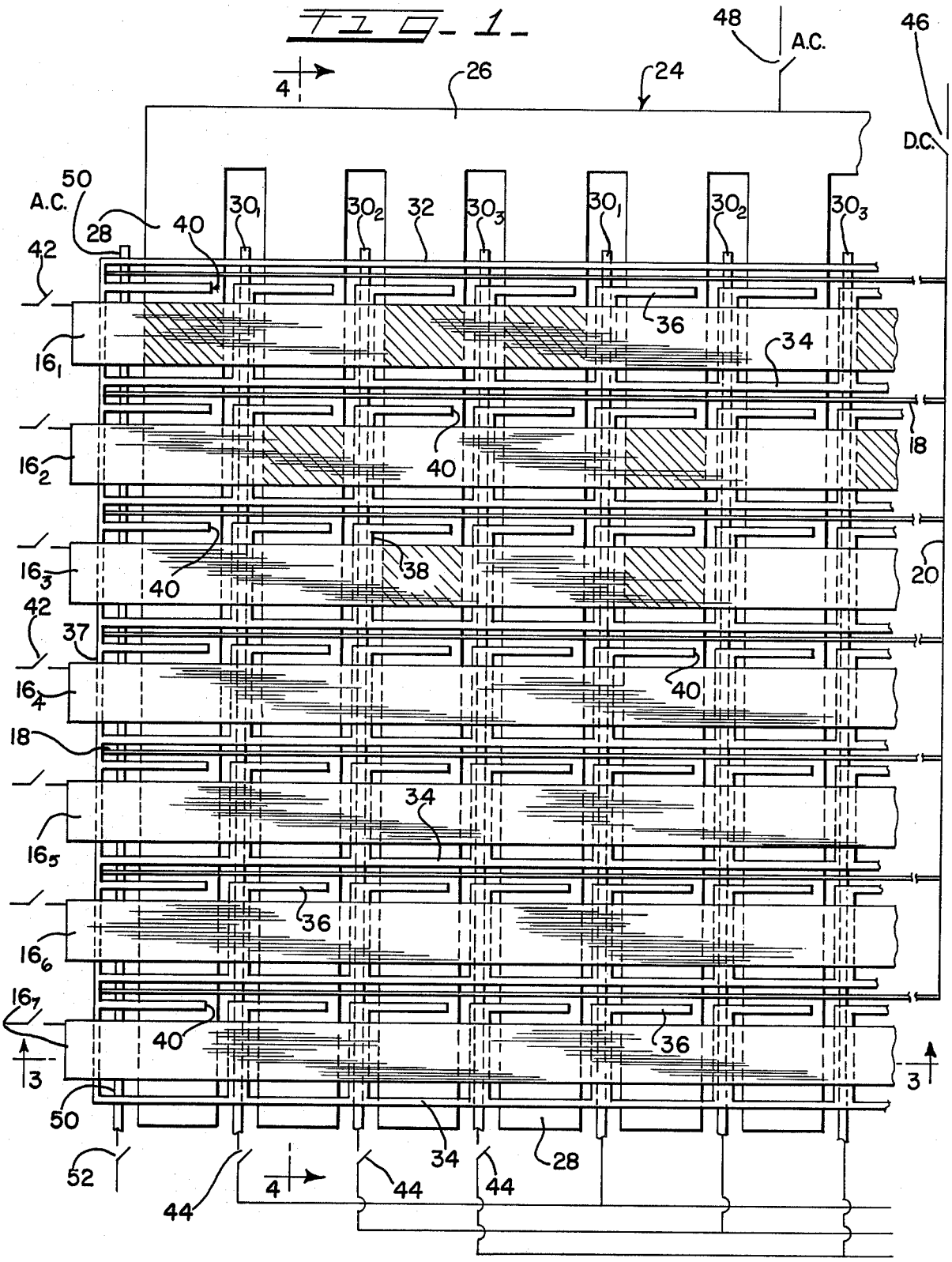
FIG. 1 is a fragmentary plan view illustrating the electrode and cell arrangement incorporated in a device characterized by the features of this invention.
Figure 2:
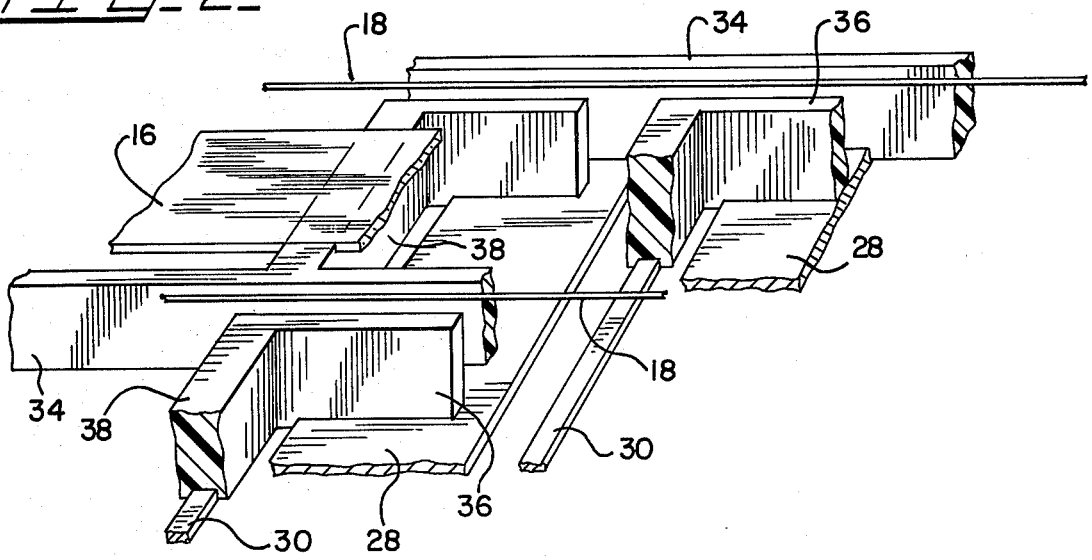
FIG. 2 is a fragmentary perspective view of a section of the device.

The structure also includes a start electrode 50 and its associated switch 52 as illustrated at the left-hand side of FIG. 1. This start electrode, as will be more specifically described, provides an initial DC discharge which is adapted to be transferred across the device, and which is ultimately utilized for purposes of lighting the individual cells and thus achieving the desired displays.

Figure 6:
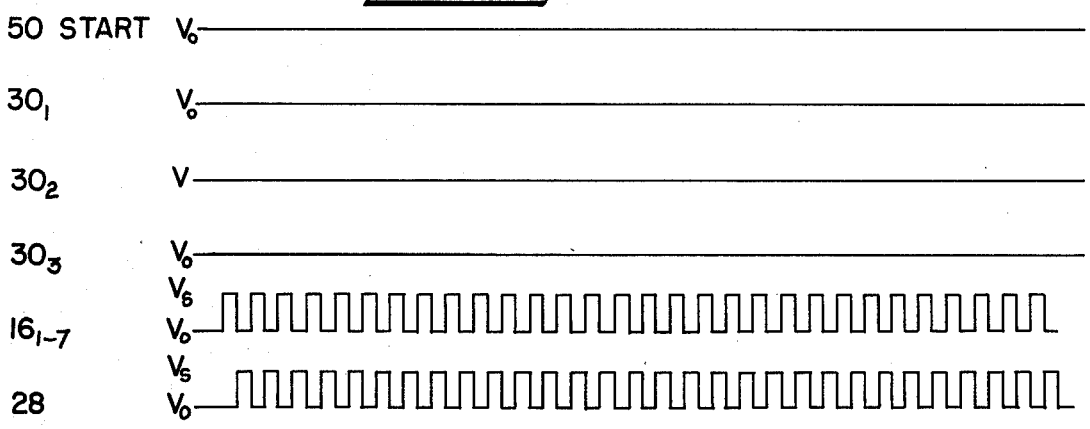
Figure 5:
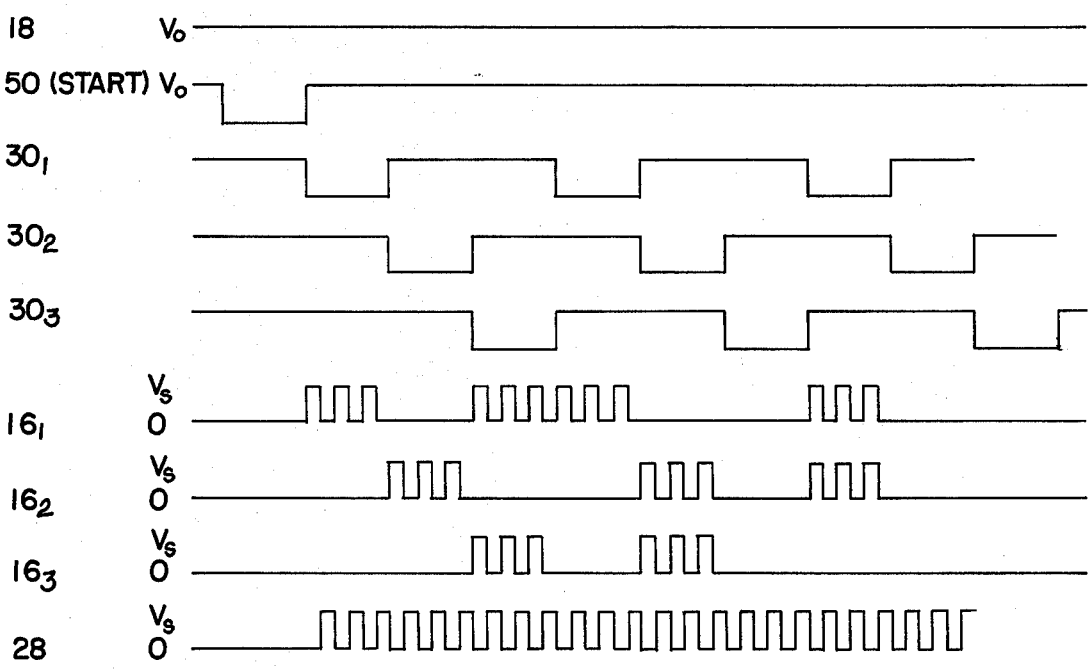
FIG. 5 is an illustration of wave forms which are characteristic of the operation of the device; and, FIG. 6 is an illustration of further wave forms characteristic of the operation of the device.

The operation of display devices of the type described can be more readily understood by a consideration of the wave forms illustrated in FIGS. 5 and 6 as well as the structure already described. In FIGS. 5 and 6, the numerals utilized for identifying the respective electrodes are associated with the respective wave forms whereby the voltage characteristic of the electrodes during an operating sequence is indicated.

Referring to FIG. 5, it will be noted that start DC electrode 50 is pulsed negatively, typically for about 90 microseconds, by closing switch 52 which results in a DC discharge to the left of the first vertical row of cells shown in FIG. 1. In this connection, the switch 46 remains closed during the loading of a display whereby the DC electrodes 18 are maintained at a positive voltage $V_o$ throughout the loading operation.

The DC discharge referred to is transferred to the right side of the first electrode 38 by opening the start switch 52 and closing the switch 44 of the first electrode 30 ($30_1$). Because of the positions of the electrodes, this results in a discharge opposite the openings 40 for the entire left-hand vertical row of cells as illustrated in FIG. 1.

Assuming that it is desired to light only the top cell in this vertical row, the switch 42 for the top electrode $16_1$ is closed for a period of about 15 microseconds, this resulting in a momentary pulse as shown in FIG. 5. It will be noted that AC electrodes 28 are continuously pulsing since the switch 48 is closed throughout the display loading sequence. The potential differences which develop due to the momentary pulsing of the electrode $16_1$ and the continuous pulsing of the electrode 28, combined with the DC discharge created at the opening 40 for this first cell results in gas ionization.

The conditions for gas ionization may be described in terms of the relative voltage conditions which prevail during the operating sequence just described. The following symbols will be of assistance when considering such conditions:

$\Delta$ V primed — $V_f - V_f'$ $V_s$ — Sustained signal of electrodes 28 and pulsing signal of electrodes 16

$V_w$ — Wall voltage of cell $V_f$ — Firing or gas ionization voltage $V_f'$ — Reduced firing or gas ionization voltage when the AC cell is primed with ionized particles In cells having the sustained signal of electrodes 28, firing will not occur even when this cell is primed since the voltage will still be less than $V_f$. When an electrode 16 is pulsed, the voltage for a given cell which is not exposed to a priming signal will still be less than $V_f$. The gas for that cell will ionize, however, when the cell is exposed to a priming signal because that DC discharge operates to lower the firing voltage. This creates the condition:

$$V_s > V_f'$$

where $V_f' = V_f - \Delta V$ primed, and $\Delta V$ primed is the reduction in firing voltage due to priming of the cell with charged particles. As indicated, this is the condition prevailing in FIG. 5 when the combined pulsing of electrodes 28 and electrode $\mathbf{16_1}$ is coupled with the presence of a priming signal in electrode $\mathbf{30_1}$.

The priming signal is shifted to the second vertical row of cells by closing the switch 44 for the electrode $\mathbf{30_2}$. Pulsing of a selected electrode 16 will then result in lighting of a cell in this second vertical row. In the example indicated in FIG. 5, the electrode $\mathbf{16_2}$ is pulsed whereby the cell located diagonally downwardly from the upper left-hand corner cell will be lit.

The priming signal is then shifted to the next electrode $\mathbf{30_3}$ as shown in FIG. 3, and the electrode $\mathbf{16_3}$ from the top is simultaneously pulsed. This operates to light the next diagonally downwardly positioned electrode.

As shown in FIG. 5, the electrode $\mathbf{16_1}$ is also pulsed while a priming signal is present adjacent the third vertically extending row of cells. Accordingly, the uppermost cell in this third row will be lit simultaneously with the third cell in this row.

For purposes of illustration, the four cells which are lit in accordance with the foregoing discussion are cross hatched in FIG. 1. FIG. 5 also illustrates the manner in which the succeeding cells cross hatched in FIG. 1 are lit. This is accomplished by first shifting the priming charge to the next position by closing the switch 44 for the set of electrodes $\mathbf{30_1}$. This creates a priming signal for the fourth row of cells, but it will be noted that a priming signal is not developed for the first row of cells since there is no charge available for shifting from the starting electrode 50 to the first electrode 30.

The top cell in the fourth row is lit due to pulsing of the electrode $\mathbf{16_1}$. Following this, the switch 44 for the set of electrodes $\mathbf{30_2}$ is closed to shift the priming signal to the fifth row, and the electrodes $\mathbf{16_2}$ and $\mathbf{16_3}$ are then simultaneously operated. This lights the second and third cells in the fifth row.

The priming signal is shifted again by closing the switch 44 for the set of electrodes $\mathbf{30_3}$, but it will be noted that none of the electrodes 16 are operated during this stage of the operation. Accordingly, there are no cells lit in the sixth row. Shifting of the priming signal to the next position is accomplished by again operating the switch 44 for the set of electrodes $\mathbf{30_1}$, and it will be noted that electrodes $\mathbf{16_1}$ and $\mathbf{16_2}$ are also operated at this stage. This results in lighting of the top two cells in the seventh row, as illustrated in FIG. 1.

It will be appreciated that the specific operation described includes only pulsing of the three electrodes $\mathbf{16_1}$, $\mathbf{16_2}$, and $\mathbf{16_3}$ shown in FIG. 1, and that lighting of cells in the lower part of the device can be accomplished by selective operation of the remaining electrodes $\mathbf{16_4}$ – $\mathbf{16_7}$. Seven such electrodes are employed since this provides a convenient means for displaying letters and numbers; however, different configurations are obviously applicable.

FIG. 6 illustrates the manner in which displays are held in the device. Once a cell has been turned on, a wall charge is built up in that cell. The voltage pulse sequence as shown in FIG. 6 will turn on all cells which had been turned on during the load operation since in these cells:

$$V_s + V_w > V_f$$

Those cells which were not turned on during the load operation will not have a built-up wall charge, and in these cells:

$$V_s < V_f$$

Wall charge, once built up on the walls of a cell will gradually dissipate but sufficient wall charge will remain for several seconds. In a typical device, the entire loading sequence will be completed while there is sufficient wall charge for all cells for the cells to ignite when the voltage sequence of FIG. 6 is applied. For example, the typical load scan time per column is 90 microseconds, and assuming that there are 240 columns in the horizontal direction (equivalent to 40 characters), the load time to scan through all columns will be .021 seconds. Therefore, the decay of wall charge on the leftmost display cells will be insignificant by the time the hold sequence begins.

It will be noted that during the loading sequence, as shown for example in FIG. 1, the top cell in the third vertical row is lit subsequent to lighting of the top cell in the first vertical row. When a signal is applied to electrodes $\mathbf{16_1}$ for purposes of lighting the top cell in the third row, this creates the aforementioned "hold" condition for the top cell in the first row since there is simultaneous pulsing of the electrode $\mathbf{16_1}$ and electrode 28.

When a particular load pattern calls for ionization of a cell in a vertical row, for example the fourth cell from the top in vertical row one, and does not call for the loading of any fourth cell in any other vertical row, then this fourth cell will not be lit at any other time during the subsequent loading procedure. As indicated, however, this will not affect the operation of the device since a sufficient wall charge for this fourth cell in vertical row one will be maintained so that lighting of that cell will occur when the hold sequence of FIG. 6 is initiated.

Bulk erasure of the display is accomplished by removing the wall charge from all display cells. This may be achieved, for example, by slowly reducing the voltage $V_s$ while maintaining the pulsing sequence. This has the effect of walking the wall charge back to 0 value. This is a recognized technique for eliminating an ionized condition between electrodes.

Means are also available for selectively erasing and rewriting information in a particular portion of the display. This may be achieved by using the so-called "method of electronic inversion" as described in an article by J. D. Schermerhorn, "Internal Random-Access Address Decoding in an AC Plasma Panel", SID Digest, May, 1974, pp. 22–23. The suggested sequence, referring to row 3 of FIG. 1, is as follows:

(1) Invert all display dots in the display, i.e., turn on all off dots and turn off all on dots.
(2) Scan columns up to column 3.
(3) Light all dots in column 3 by closing all switches 42 for lines $16_1$ – $16_7$.
(4) Again invert all display dots in the display.
(5) Scan columns up to column 3.
(6) Select proper dots in column 3 by closing appropriate switches 42 for lines $16_1$ – $16_7$.

It will be noted that the device of this invention does not involve shifting of displays which are developed in the device. When a cell is lit, it remains lit and its position is stationary until erasure is desired. To illustrate this feature, it will be appreciated that words are introduced into the device by starting with the display of the first letter and continuing to "write" the word on the display in the normal letter sequence. This is in contrast to displays which continuously shift information as it is introduced whereby the first information introduced is ultimately displayed at the end of the line of information. That is, in the case of a word, the last letter of the word is introduced first in such displays.

The concepts of the invention are applicable in various alternative structural arrangements. It is contemplated that, in the system illustrated, the electrodes 16 be coupled for simultaneous and continuous pulsing and the electrodes 28 would then be individually controlled so that specific cell selection is still available.

The invention also contemplates the provision of multiple line devices, for example, devices as illustrated which include a plurality of horizontal rows of cells to enable "writing" on one line and, in addition, one or more additional sets of vertically spaced rows of cells providing one or more additional lines. In setting up such a multiline device, coupling of electrodes could be accomplished in various fashions. For example, the electrodes 16 for a given line could all be coupled for continuous operation. The electrodes 28, for the first vertical row of each line could also be commonly coupled, the electrodes 28 for the second vertical row in each line could be commonly coupled, etcetera. By separately controlling the position of the priming charge in each line, that is, by providing separate circuit controls for the electrodes 30 in each line, different information could then be introduced into each line.

Another contemplated alternative would involve a multiline device wherein the electrodes 28 for a particular line would be commonly coupled as shown in FIG. 1. In the manner of the previously described alternative, the electrodes 16 for each corresponding horizontal row in each line would then be commonly coupled, that is, the electrodes $16_1$ for each line would be simultaneously pulsed, the electrodes $16_2$ for each line would be simultaneously pulsed, etcetera. Again, separate control of the position of the priming charge in each line will enable the development of different information in each line.

It will be understood that various other changes and modifications may be made in the devices described herein without departing from the spirit of this invention particularly as defined in the following claims.

That which is claimed is:

1. In a plasma discharge device of the type having a walled structure containing an ionization medium, electrodes disposed on opposite sides of the walled structure, and means for applying potential differences between adjacent electrodes whereby the medium will emit light proximate the adjacent electrodes, the improvement wherein said electrodes include a first AC electrode on one wall surface, a second AC electrode on an opposed wall surface and crossing the first electrode, and means for developing a DC discharge at selected locations in the vicinity of said first and second electrodes, said DC discharge means including a first DC electrode on one wall surface and a second DC electrode on the opposed wall surface crossing the first DC electrode at a location in the vicinity of the first and second electrodes for developing a DC discharge at the crossing location, said DC discharge, combined with the development of a potential difference between said AC electrodes at the crossing thereof resulting in the ionization of said gas proximate the AC electrode crossing.

2. A device in accordance with claim 1 including a plurality of insulating walls extending between said opposed wall surfaces, said insulating walls defining individual cells containing said medium.

3. A device in accordance with claim 2 including openings defined by each of said individual cells, said DC discharges being developed selectively adjacent said openings.

4. A device in accordance with claim 3 wherein a plurality of said first AC electrodes and a plurality of said second AC electrodes are provided in said device, said first and second electrodes being disposed whereby each first electrode extends opposite a plurality of the second electrodes and whereby each second electrode extends opposite a plurality of the first electrodes, a portion of a first electrode and a portion of a second electrode being exposed to the medium in each cell, and means for selectively operating the electrodes whereby potential differences can be developed between electrode portions of individual cells.

5. A device in accordance with claim 4 wherein said electrodes comprise strips with said first electrodes extending in parallel spaced apart relationship across said one wall surface and said second electrodes extending in spaced apart parallel relationship across said opposed wall surface, said first and second electrodes extending parallel to each other.

6. A device in accordance with claim 5 wherein said first electrodes are coupled together for the simultaneous application of electrical signals thereto, and wherein said second electrodes are individually connected for the application of electrical signals thereto.

7. A device in accordance with claim 6 including a first set of DC electrodes extending in parallel relationship with said first electrodes, the DC electrodes in said first set being interleaved with the first electrodes, and including a second set of DC electrodes extending in parallel relationship with said second electrodes, the DC electrodes of said second set being interleaved with the second electrodes.

8. A device in accordance with claim 7 wherein the electrodes of said first and second sets of DC electrodes are respectively positioned on said opposed wall surfaces with individual opposed electrodes crossing at spaced intervals whereby DC discharges can be developed at said intervals upon selective operation of the DC electrodes, the openings defined by said cells being disposed adjacent said intervals.

9. A device in accordance with claim 8 including a start DC electrode adapted for developing DC discharges at intervals along a line crossing the electrodes of one of said sets of DC electrodes, and control means associated with the other set of DC electrodes for shifting each of said DC electrodes in steps away from said start electrode and sequentially to each electrode in said other set.

10. A method for operating a plasma discharge display device of the type having at least one channel defined within a walled structure and containing an ionizable medium, electrodes being disposed on opposite sides of the channel and means being provided for applying potential differences between adjacent electrodes whereby the medium will emit light proximate the adjacent electrodes, the improvement comprising the steps of providing a first AC electrode on one wall surface, continuously applying AC pulses to said first AC electrode, providing a plurality of second AC electrodes crossing said first electrode at spaced intervals, selectively applying pulses to said second electrodes whereby potential differences are selectively developed between said first electrode and said second electrodes, and selectively applying a DC discharge adjacent areas of the device characterized by said potential differences for ionizing said medium in said areas.

11. A method in accordance with claim 10 wherein a first DC electrode is positioned adjacent said first electrode and a plurality of additional DC electrodes extend perpendicular to said first DC electrode, said DC discharges being developed by selectively applying signals to said second DC electrodes.

12. A method in accordance with claim 11 wherein a plurality of said first AC electrodes are positioned in spaced apart parallel relationship relative to said first AC electrode, each of the first AC electrodes crossing a plurality of second AC electrodes, said potential differences being selectively developed between crossing areas of said first and second electrodes.

13. A method in accordance with claim 12 wherein wall charges are developed in those areas where said potential differences are selectively developed, and including the step of continuously developing potential differences between said AC electrodes which, combined with said wall charges, are sufficient to hold the medium in said areas in an ionized state.

14. A method in accordance with claim 13 wherein said continuous developing of potential differences occurs subsequent to complete loading of said device.

15. A method in accordance with claim 13 including the step of erasing the display held in the device by gradually reducing said potential differences so that said wall charges gradually dissipate.

16. A method in accordance with claim 12 wherein said areas comprise a plurality of spaced apart rows, and including a technique for selectively erasing all ionized areas in a row, said technique comprising the steps of inverting the display pattern for the device by developing potential differences and DC discharges for all areas not previously ionized while avoiding the development of said potential differences in the areas previously ionized, ionizing said medium in all areas of said row to be erased, and repeating said inverting step to restore said potential differences which were selectively developed except in said row to be erased.

17. A method in accordance with claim 16 including the further step of selectively restoring ionized areas in said row to be erased by selectively applying potential differences in said row between crossing areas of said first and second electrodes.

18. In a plasma discharge device of the type having a walled structure containing an ionization medium, electrodes disposed on opposite sides of the walled structure, and means for applying potential differences between adjacent electrodes such that the medium will ionize proximate the adjacent electrodes, the improvement wherein:

the discharge device comprises ionization medium-containing ionization cells in a row by column array of at least two cells per row and at least two cells per column;

said cells being defined between the opposed wall surfaces by a first plurality of insulating row walls and a second plurality of insulating column walls, said row walls defining corridors therebetween and defining an opening along one side of each cell;

said electrodes including a row array of first elongated AC electrodes on one wall surface and a columnar array of second elongated AC electrodes on the opposed wall surface, said row and column AC electrodes crossing at points coincident with each cell;

means for developing a potential difference between said AC electrodes at selected cross points; and means for sequentially developing columnar arrays of DC discharges in the corridors adjacent the openings of each column of cells, said DC discharge in combination with the application of the potential difference at selected AC electrode cross points ionizing the medium in the associated cells.

19. The plasma discharge device of claim 18, wherein the DC discharge means includes a row array of first elongated DC electrodes and a columnar array of second elongated DC electrodes, said row and column electrodes crossing at points adjacent the openings of said cells, and being adapted for sequentially effecting a discharge in the corridors adjacent the openings of each column of cells.

* * * * *

UNITED STATES PATENT OFFICE

CERTIFICATE OF CORRECTION

Patent No. 4,105,930 Dated August 8, 1978

Inventor(s) William E. Coleman

It is certified that error appears in the above-identified patent and that said Letters Patent are hereby corrected as shown below:

Column 9, claim 9, line 4, after "DC", "electrodes" should be -- discharges --.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*